US005724932A

United States Patent [19]

Antone

[11] Patent Number: 5,724,932

[45] Date of Patent: Mar. 10, 1998

[54] ALTERNATING CURRENT CONTROL APPARATUS AND METHOD FOR GLOW PLUGS

[75] Inventor: James A. Antone, Edwards, Ill.

[73] Assignee: Caterpillar Inc., Peoria, Ill.

[21] Appl. No.: 733,888

[22] Filed: Oct. 18, 1996

[51] Int. Cl.[6] ..... F02P 19/02

[52] U.S. Cl. ..... 123/145 A

[58] Field of Search ..... 123/145 A, 179.21, 123/179.6

[56] References Cited

U.S. PATENT DOCUMENTS 4,858,576 8/1989 Jeffries et al. ..... 123/145 A 5,367,994 11/1994 Hinkle ..... 123/145 A

*Primary Examiner*—Tony M. Argenbright

*Attorney, Agent, or Firm*—David M. Masterson; R. Carl Wilbur

[57] ABSTRACT

In one aspect of the present invention, an apparatus for controlling the temperature of a plurality of glow plugs of a multi-cylinder internal combustion engine is disclosed. A voltage sensor produces a signal relative to the magnitude of the sensed voltage across a glow plug. A microprocessor compares the magnitude of the sensed signal with a preselected magnitude indicative of a predetermined temperature glow plug and responsively produces a current command signal. An alternator receives the current command signal and responsively delivers alternating current to the glow plugs.

16 Claims, 5 Drawing Sheets

ALTERNATING CURRENT CONTROL APPARATUS AND METHOD FOR GLOW PLUGS

TECHNICAL FIELD

This invention relates generally to an apparatus for controlling the energization of a plurality of glow plugs of an internal combustion engine and, more particularly, to an apparatus for continually regulating alternating current through the plurality of glow plugs.

BACKGROUND ART

Alternate fuels, such as low cetane fuels, are becoming commonplace in many areas of the world. In order to burn alcohol fuel in a diesel engine, additional heat must be supplied, usually from the glow plugs already present in the engine. Since glow plugs are not designed for prolonged use, they typically fail within a short period of time.

Precision voltage control systems utilizing a direct current source have attempted to regulate power consumed by the glow plugs during operation to lengthen their usable lives. However, an electrical field setup by the direct current causes ion migration in the glow plugs. In time this ion migration results in the breakdown of the glow plugs. Moreover, as the engine operates and its temperature changes, the direct current voltage control systems tend to overdrive the glow plugs with excess power, which damages the glow plugs and shortens the glow plug life due to excessive glow plug overheating.

The present invention is directed toward overcoming the problems of relatively short glow plug life when used in a continuous powered applications such as low cetane fueled engines.

DISCLOSURE OF THE INVENTION

In one aspect of the present invention, an apparatus for controlling the temperature of a plurality of glow plugs of a multi-cylinder internal combustion engine is disclosed. A voltage sensor produces a signal relative to the magnitude of the sensed voltage across a glow plug. A microprocessor compares the magnitude of the sensed signal with a preselected magnitude indicative of a predetermined temperature glow plug and responsively produces a current command signal. An alternator receives the current command signal and responsively delivers alternating current to the glow plugs.

In another aspect of the present invention, an apparatus for controlling the temperature of a plurality of glow plugs of a multi-cylinder internal combustion engine is disclosed. A voltage and current sensor produces signals relative to the magnitude of the sensed voltage and current associated with a glow plug. A divider divides the voltage signal by the current signal and produces a sensed resistance signal. A microprocessor compares the magnitude of the sensed resistance signal with a preselected magnitude indicative of a predetermined temperature glow plug and responsively produces a current command signal. An alternator receives the current command signal and responsively delivers alternating current to the glow plugs.

BEST MODE FOR CARRYING OUT THE INVENTION

The present invention is directed toward a method and apparatus for prolonging the life of ceramic glow plugs that are used to aid in the combustion of an internal combustion engine.

Figure 1:
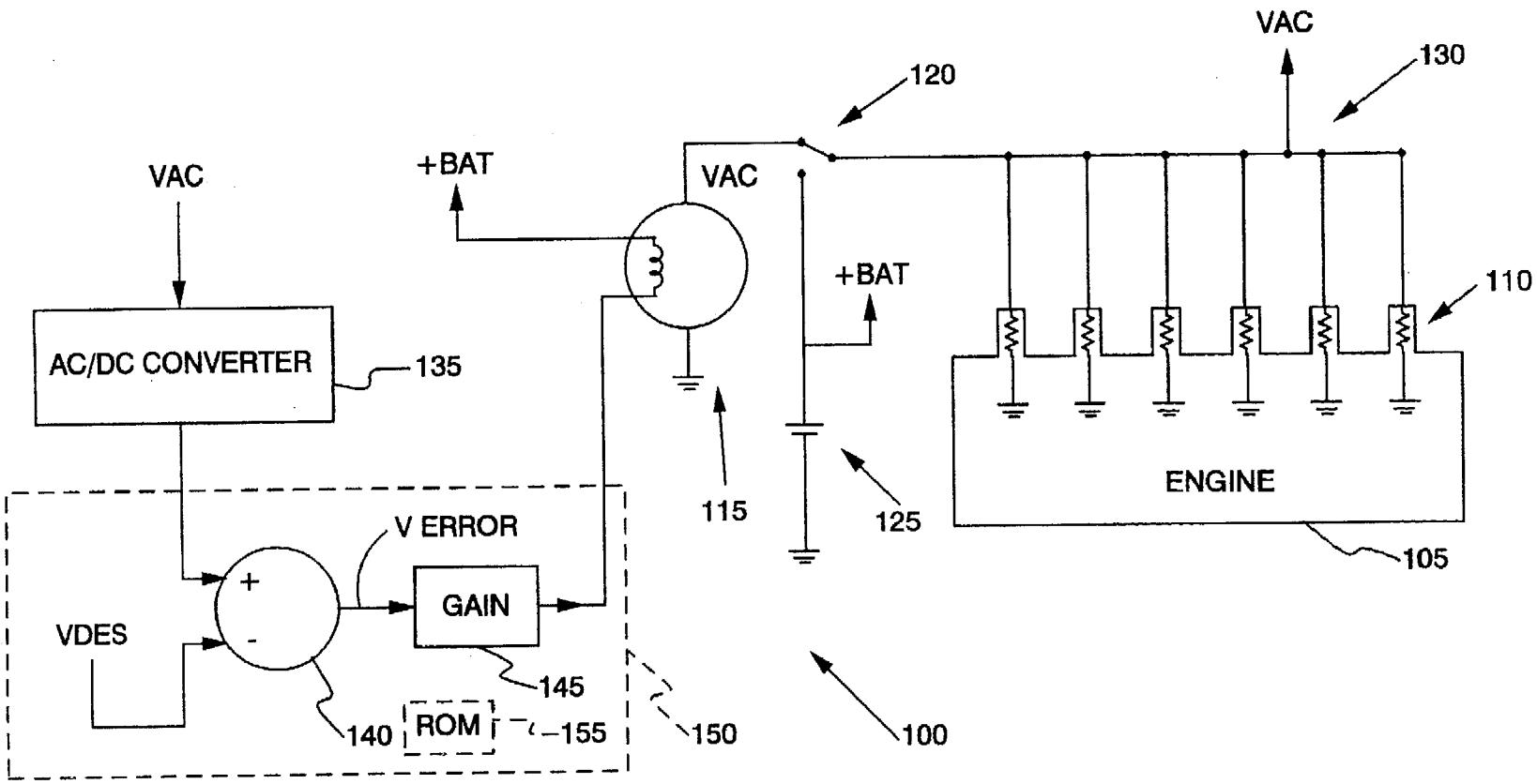
FIG. 1 illustrates a first embodiment of the present invention that relates to a single phase alternating current glow plug control apparatus that regulates the glow plug voltage.

FIG. 1 illustrates one embodiment of an alternating current glow plug control apparatus 100. An internal combustion engine 105 includes a plurality of glow plugs 110. The glow plugs 110 include a ceramic portion made of silicon nitrate or other suitable ceramic material disposed therein. Power is provided to the glow plugs 110 in the form of alternating current via alternator 115. Thus, by providing alternating current power to the ceramic glow plugs, the current through the glow plugs changes direction every half cycle to reduce the ion migration. The embodiment shown in FIG. 1 represents a single phase alternating current configuration. Note, the alternator 115 is modified in a well known manner to produce an alternating current voltage at a single phase.

A pre-glow switch 120 is provided to energize the glow plugs 110 with power from a battery 125. The pre-glow switch is selectable to a first position that connects the glow plugs directly to the battery when the engine is starting. Once the engine 105 has started, the pre-glow switch is selectable to a second position that connects the glow plugs to the alternator 115 to energize the glow plugs with alternating current voltage.

A voltage sensor 130 senses the glow plug voltage and produces a signal relative to the magnitude of the sensed voltage. The voltage sensor 130 may be configured as a simple voltage divider, for example. The voltage signal is delivered to an AC-DC converter 135 which converts the alternating current voltage to a direct current voltage. The converted voltage is delivered to a summing amplifier 140 which produces a voltage error signal in response to the difference between the converted voltage glow plug signal and a desired glow plug voltage signal. The desired glow plug voltage signal represents a desired magnitude of glow plug voltage. Responsively, the voltage error signal is delivered to a gain stage 145 which multiplies the error signal by gain value; thereby, converting the voltage error signal into a current command signal. The alternator 115 receives the current command signal that travels through the alternator field winding to produce a single phase alternating current signal. The single phase alternating current signal is delivered to the plurality of glow plugs to control the voltage of each glow plug to the desired glow plug voltage.

Preferably, the summing amplifier 140 and gain stage 145 are embodied in a microprocessor base controller 150. The microprocessor base controller 150 includes memory 155 that stores a multi-dimentional software map that contains a plurality of desired voltage values that corresponds to a plurality of various engine operating parameters such as cylinder temperature, cylinder pressure, engine speed, and the like. The controller 150 selects a desired voltage value based on the various parameters. Advantageously, the plurality of desired voltage values are selected to correspond to predetermined glow plug power. Thus, the present invention controls the glow plug voltages to the desired voltage value in order to maintain the glow plugs at a constant temperature. Note, the values of the map are obtained from empirical data based on experimentation and mathematical modeling. Further, as is apparent to those skilled in the art, the software map may easily be substituted by a mathematical set of equations.

As described, the glow plug voltage is monitored. This value is compared with a preselected glow plug voltage that is the desirable voltage of the glow plug. If the obtained voltage differs from the preselected voltage, the glow plug voltage is then increased or decreased by varying the alternating field current until the measured voltage substantially equals the preselected voltage. Note that, because the glow plugs are connected in parallel with each other, either one or all of the glow plugs can be sensed in order to determine the representative voltage.

Additional embodiments of the present invention will now be described. The same elements as those of the first embodiment will be given the same numerals and the explanation thereof will be omitted.

Figure 2:
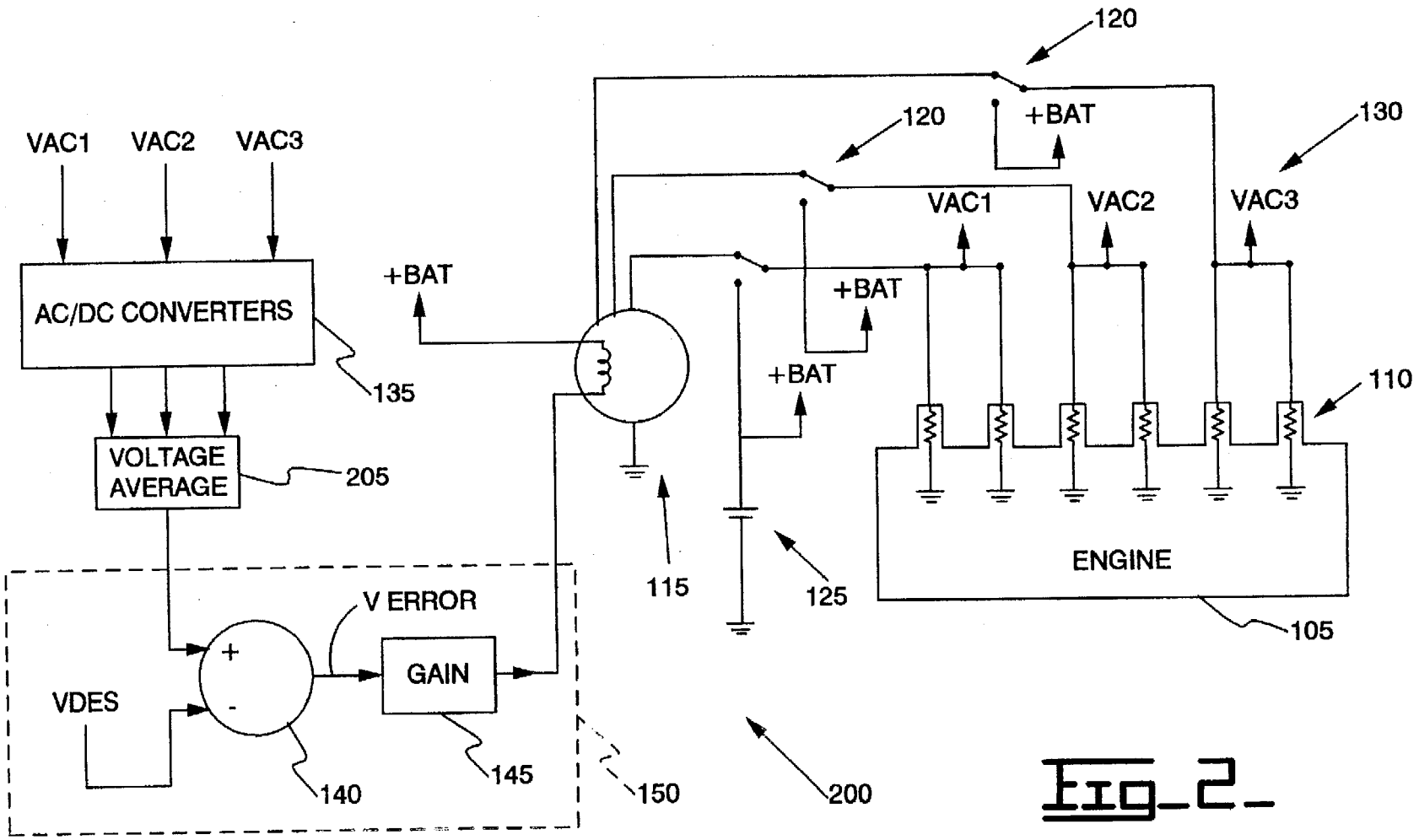
FIG. 2 illustrates a second embodiment of the present invention that relates to a three phase alternating current glow plug control apparatus that regulates the glow plug voltage.

Reference is made to FIG. 2 which shows another embodiment of the present invention. The alternating current glow plug control apparatus 200 shown in FIG. 2 is based on a three-phase voltage implementation where each phase controls a glow plug pair. The AC-DC converter 135 receives the sensed glow plug voltage from each phase and delivers respective direct current equivalent voltages to a voltage averaging circuit 205. The voltage averaging circuit 205 averages the three voltages and delivers an average voltage to a summing amplifier 140 which produces the voltage error signal. The voltage error signal is delivered to a gain stage 145 which multiplies the error signal by gain value to produce a current command signal. The alternator 115 receives the current command signal and delivers a predetermined single phase alternating current signal to each glow plug pair in order to control the voltage of each glow plug to the desired glow plug voltage.

It is well known that the amount of power consumed or dissipated by a glow plug is related to the glow plug temperature. The first and second embodiments of the present invention continuously monitor the voltage of a glow plug and controls the voltage of the plurality of glow plugs to a desired voltage in order to protect them from overheating. Due to this substantial continuous voltage feedback, the glow plug voltage is prevented from drifting undesirably from the preselected voltage. Because the glow plug voltage is maintained at a preselected or desired voltage, the power consumed by the glow plugs will likewise be maintained at a desired power level.

Figure 3:
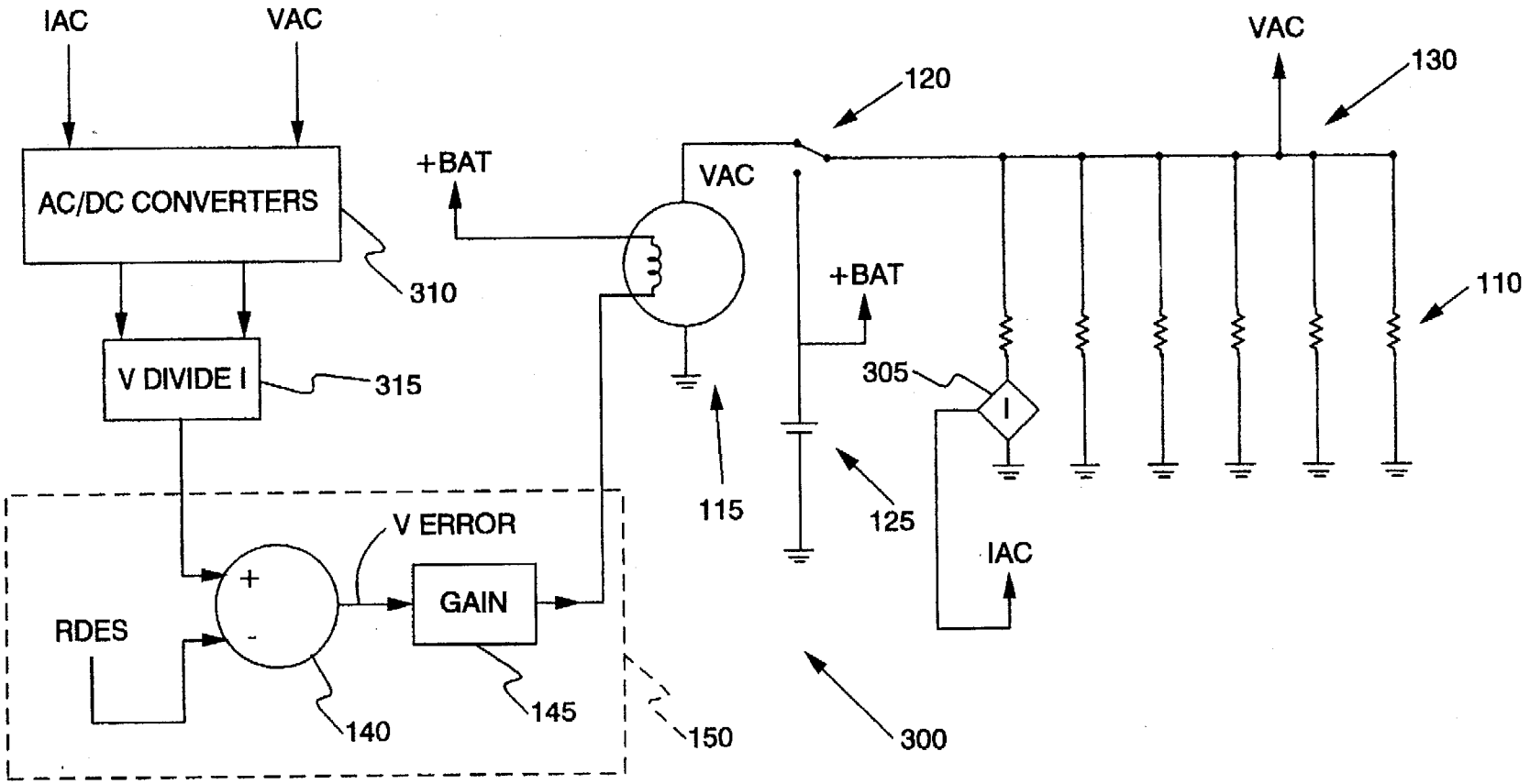
FIG. 3 illustrates a third embodiment of the present invention that relates to a single phase alternating current glow plug control apparatus that regulates the glow plug resistance.

A third embodiment of the present invention is shown in FIG. 3, which illustrates a single phase alternating current resistance control apparatus 300. The third embodiment 300 computes the glow plug resistance by dividing the glow plug voltage by the glow plug current.

A voltage sensor 130 senses the glow plug voltage and produces a glow plug voltage signal relative to the magnitude of the sensed voltage. A current sensor 305 senses the glow plug current and produces a signal relative to the magnitude of the sensed current. The glow plug voltage and current signals are delivered to a plurality of AC-DC converters 310 which convert the signals from an alternating current form to a direct current form. The respective converted signals are delivered to a divider circuit 315 where the converted voltage signal is divided by the converted current signal to produce a glow plug resistance signal indicative of the average resistance of the glow plugs. A summing amplifier 140 receives the glow plug resistance signal and compares the signal magnitude to a desired glow plug resistance signal magnitude. The summing amplifier 140 produces a resistance error signal in response to a difference between the actual and desired glow plug resistance signal magnitudes. A gain circuit 145 multiplies the error signal by a gain value to produce a current command signal which is delivered to the alternator 115. Responsively, the alternator 115 delivers a single phase alternating current signal to the plurality of glow plugs in order to control the resistance of each glow plug to the desired glow plug resistance.

As described, the glow plug voltage is divided by the glow plug current to obtain an indication of the glow plug's resistance. This value is compared with a preselected glow plug resistance that is the desirable resistance of the glow plug. The preselected or desired glow plug resistance is determined by the microprocessor based controller 150 from a software map. The software map includes a plurality of desired resistance values that correspond to a plurality of various engine operating parameters. The desired resistance value is selected to correspond to a desired glow plug temperature. If the glow plug resistance differs from the preselected resistance, then the glow plug resistance is increased or decreased until it substantially equals the preselected resistance.

It is well known that glow plug resistance is related to glow plug temperature. As an operating engine cycles through a range of temperatures, the temperature of the glow plugs changes accordingly. The apparatus continuously monitors the resistance of a glow plug and controls the resistance of the plurality of glow plugs to a desired resistance in order to protect them from overheating. Due to this substantial continuous resistance feedback, the glow plug resistance is prevented from drifting undesirably from the preselected resistance. Thus, because the glow plug resistance is maintained at a desired resistance, the glow plug temperature is likewise maintained at a desired temperature. Note, since the glow plugs are connected in parallel with each other, all of the glow plugs are controlled to preselected resistance. Thus, either all or one of the glow plug voltages and currents can be sensed in order to determine a representative glow plug resistance value.

Figure 4:
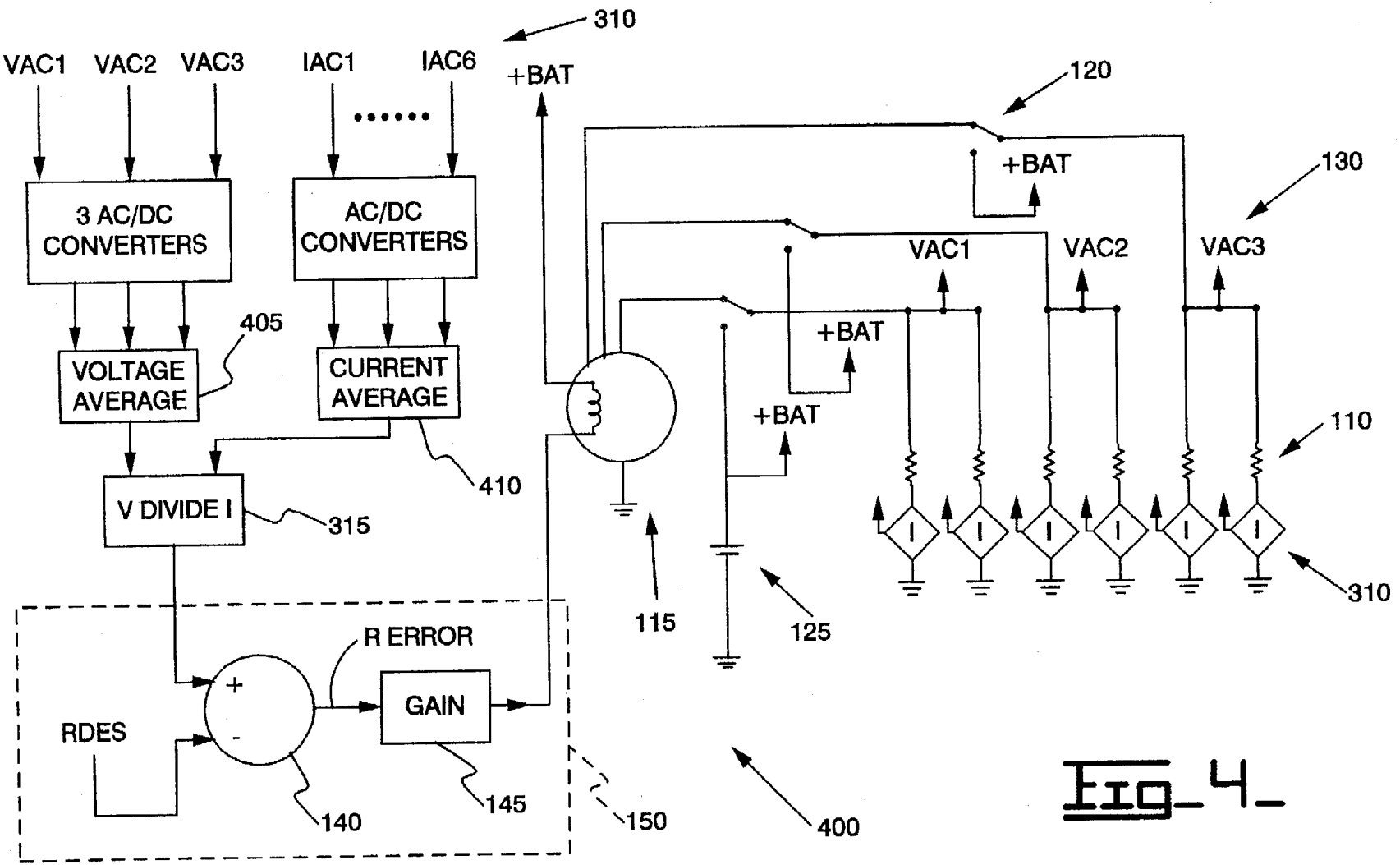
FIG. 4 illustrates a fourth embodiment of the present invention that relates to a three phase alternating current glow plug control apparatus that regulates the glow plug resistance.

Reference is made to FIG. 4 which shows yet another embodiment of the present invention. The alternating current glow plug control apparatus 400 shown in FIG. 4 is based on a three-phase voltage implementation where each phase controls a glow plug pair. AC-DC converters 310 receive the sensed glow plug voltage and current from each phase and delivers respective direct current equivalent signals to respective voltage and current averaging circuits 405,410. The averaging circuits average the converted signals and produce respective averaged voltage and current signals. A divider 315 receives the averaged voltage and current signals and produces a resistance signal indicative of the actual glow plug resistance. A summing amplifier 140 receives the actual and a desired glow plug resistance signals and responsively produces a resistance error signal. A gain circuit 145 multiplies the error signal by a gain value to produce a current command signal which is delivered to the alternator 115. Responsively, the alternator 115 delivers a predetermined single phase alternating current signal to each glow plug pair in order to control the resistance of each glow plug pair to the desired glow plug resistance.

Figure 5:
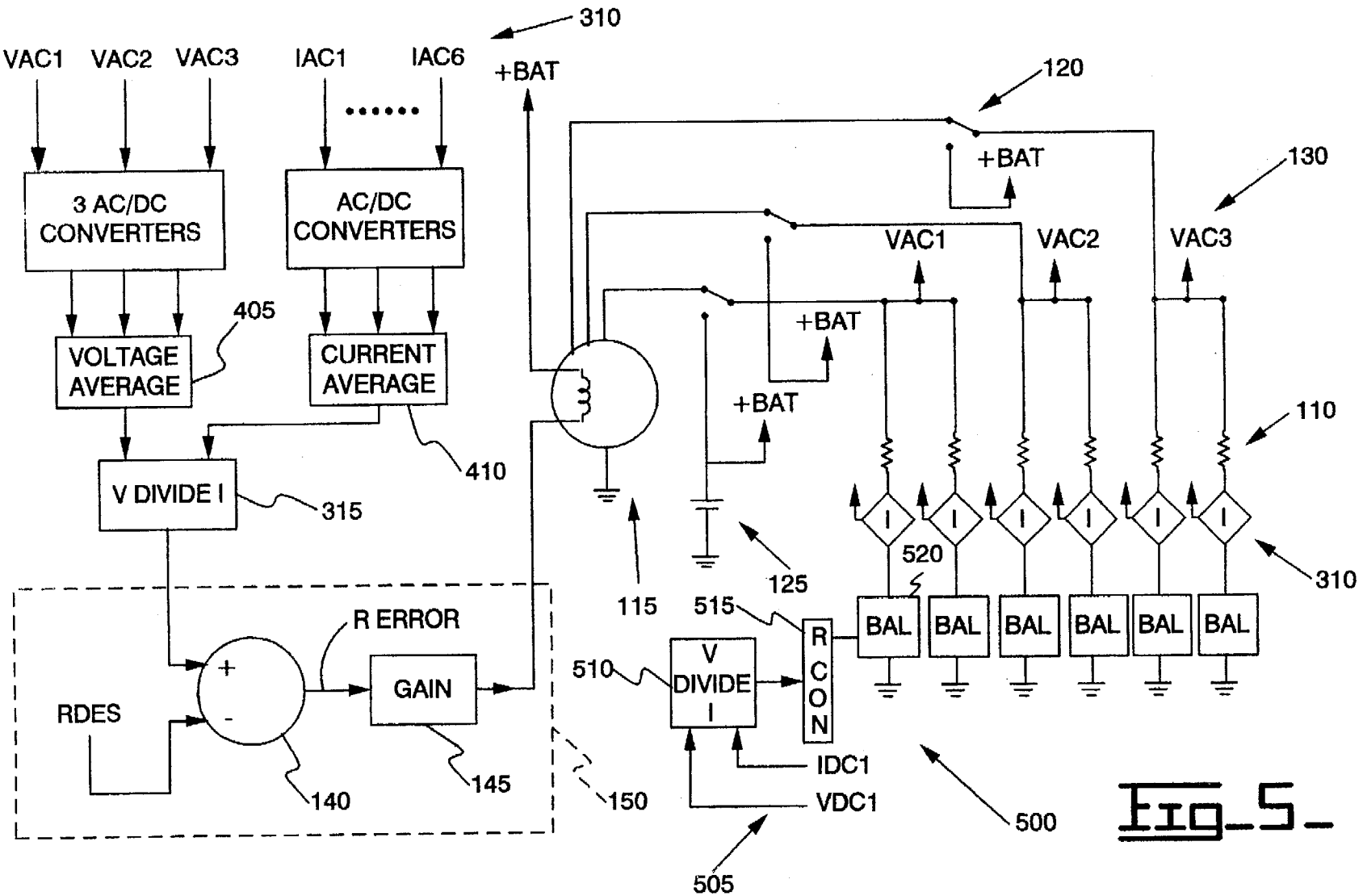
FIG. 5 illustrates a fifth embodiment of the present invention that relates to a three phase alternating current glow plug control apparatus having a ballast control that regulates the glow plug resistance.

Yet another embodiment of the present invention is shown in FIG. 5, which illustrates a three-phase alternating current resistance control apparatus 500 having a separate ballast control 505 for each glow plug. The ballast control 505 consists of a plurality of series load devices that regulate the respective glow plug resistance. More particularly, the ballast control 505 regulates the power consumed by a respective glow plug to control the glow plug temperature. Because the glow plug temperature is proportional to the glow plug resistance, the ballast control regulates the glow plug resistance to the desired resistance.

The ballast control 505 includes a divider circuit 510 that receives signals indicative of a respective glow plug current and voltage and produces a signal indicative of the particular glow plug resistance. A ballast regulator 515 receives the glow plug resistance signal, compares the actual glow plug resistance to a desired glow plug resistance and produces a ballast signal. The ballast signal is delivered to a ballast 520 to regulate the amount of power dissipated thereby in order to control the amount of power consumed by the glow plug. More particularly, the ballast signal controls the resistance of the ballast 520, which acts as a load. Thus, the greater the resistance of the ballast 520, the greater the power dissipated by the ballast, and the lessor power consumed by the glow plug. By varying the resistance of the ballast, the glow plug power and resistance is likewise varied. Thus, by monitoring the actual resistance the glow plug, the glow plug resistance can be controlled to a desired resistance. In the preferred embodiment, the ballast regulator 515 includes a summing amplifier that receives the desired and actual glow plug resistance signals, and the ballast 520 includes a FET device. Further, the microprocessor based controller 150 may form part of the ballast control 505.

Thus, the fifth embodiment of the present invention utilizes an "inner" control loop that controls each glow plug to a desired resistance value by regulating the resistance of the ballast 520, and an "outer" control loop that controls the average resistance of the collective set of glow plugs to the desired resistance value by regulating the alternator field winding current. A final embodiment of the present invention is described in a prior patent application assigned to Caterpillar, Inc. entitled "Method of Prolonging the Life of Glow plugs" having Ser. No. 08/662,173 filed on Jun. 12, 1996, which is herein incorporated by reference. Such a patent application describes a method of rotating the alternator so that the alternator can provide an alternating current voltage at any engine speed. Thus, the alternator 115 can be rotated at a constant speed during the entire engine operation, including starting. The result of such a method eliminates the need for the switch(s) 120 and battery, as well as, reduces the size of the alternator.

INDUSTRIAL APPLICABILITY

The present invention is applicable to a multi-cylinder low cetane fueled engines. As mentioned earlier, the glow plug resistance varies proportionally with the glow plug temperature. Before the engine can be started, the glow plugs must first be heated to a temperature sufficiently high to initiate combustion of the fuel. This temperature corresponds to a desired resistance value, which is calculated to give optimum glow plug life. After the glow plugs reach the preselected temperature, then the engine will start.

After the engine has started, the friction of the pistons in the cylinders, in combination with many other factors, raises the temperature inside the cylinders. In a constant voltage type control, the cylinder heat increases the glow plug temperature. As the temperature increases, the resistance increases, so the glow plug dissipates more power. However, in the glow plug alternator control of the present invention, the voltage or resistance of the glow plugs is controlled. This has the effect of controlling the power dissipated by the glow plugs. Each glow plug voltage or resistance is controlled to the preselected value and is maintained substantially at the magnitude of the preselected value.

Other aspects, objects and advantages of this invention can be obtained from a study of the drawings, the disclosure and the appended claims.

I claim:

1. An apparatus for controlling the power consumed by a plurality of glow plugs of a multi-cylinder internal combustion engine, comprising:

a voltage sensor for sensing the voltage across a glow plug and producing a signal relative to the magnitude of the sensed voltage;

a memory device for storing a software map containing a plurality of preselected voltage magnitudes that correspond to a plurality of engine operating parameters;

a microprocessor for receiving the sensed signal, the microprocessor selecting the one of the plurality of preselected voltage magnitudes, comparing the magnitude of the sensed signal with the preselected magnitude, and responsively producing a current command signal; and an alternator for receiving the current command signal and responsively delivering alternating current to the glow plugs.

2. An apparatus, as set forth in claim 1, including:

an AC-DC converter which receives the sensed signal and converts the alternating current form of the sensed signal to a direct current form;

a summing amplifier which receives the converted voltage signal and compares the converted voltage signal magnitude to the preselected voltage magnitude, and produces a voltage error signal in response to the comparison; and a gain stage which receives the voltage error signal, multiplies the error signal by gain value, and produces the command signal.

3. An apparatus, as set forth in claim 2, wherein the alternator produces a three phase alternating current voltage, where each phase energizes a respective glow plug pair.

4. An apparatus for controlling the temperature of a plurality of glow plugs of a multi-cylinder internal combustion engine, comprising:

a voltage sensor for sensing the voltage across a glow plug and producing a signal relative to the magnitude of the sensed voltage;

a current sensor for sensing the current across a glow plug and producing a signal relative to the magnitude of the sensed current;

a divider for receiving the sensed voltage and current signals, dividing the sensed signals, and producing a sensed resistance signal;

a memory device for storing a software map containing a plurality of preselected resistance magnitudes that correspond to a plurality of engine operating parameters;

a microprocessor for receiving the sensed signal, the microprocessor selecting the one of the plurality of preselected resistance magnitudes that is indicative of a predetermined glow plug temperature, comparing the magnitude of the sensed signal with the preselected magnitude, and responsively producing a current command signal; and an alternator for receiving the current command signal and responsively delivering alternating current to the glow plugs.

5. An apparatus, as set forth in claim 4, including:

an AC-DC converter which receives the sensed voltage signal and the sensed current signal and converts them from an alternating current form to a direct current form;

a summing amplifier which receives the resistance signal and compares the resistance signal magnitude to the preselected resistance magnitude, and produces a resistance error signal in response to the comparison; and a gain stage which receives the resistance error signal, multiplies the error signal by gain value, and produces the command signal.

6. An apparatus, as set forth in claim 4, wherein the alternator produces a three phase alternating current voltage, each phase energizing a glow plug pair.

7. An apparatus for controlling the temperature of a plurality of glow plugs of a multi-cylinder internal combustion engine, comprising:

a voltage sensor for sensing the voltage across the plurality of glow plugs and producing a signal relative to the magnitude of the sensed voltage;

a current sensor associated with each glow plug for sensing the current across each glow plug and producing a signal relative to the magnitude of the sensed current;

a divider for receiving the sensed voltage and current signals, dividing the sensed signals, and producing a sensed resistance signal indicative of the average resistance of the plurality of glow plugs;

a microprocessor for receiving the sensed resistance signal, comparing the magnitude of the sensed signal with a preselected magnitude indicative of a predetermined temperature glow plug, and responsively producing a current command signal; and an alternator for receiving the current command signal and responsively delivering alternating current to the glow plugs.

8. An apparatus, as set forth in claim 7, including memory for storing a software map containing a plurality of preselected resistance magnitudes that correspond to a plurality of engine operating parameters, the microprocessor selecting the one of the plurality of preselected resistance magnitudes a producing a desired resistance signal.

9. An apparatus, as set forth in claim 7, including:

an AC-DC converter which receives the sensed voltage and the sensed current signal and converts the alternating current form of the sensed voltage and currents to direct current forms;

wherein said divider receives said direct current form of said voltage and current signals and produces a direct current resistance signal;

a summing amplifier which receives and compares the direct current resistance signal and the desired resistance signal, and produces a resistance error signal in response to the comparison; and a gain stage which receives the resistance error signal, multiplies the error signal by gain value; and produces the command signal.

10. An apparatus, as set forth in claim 9, wherein the alternator produces a three phase alternating current voltage, each phase energizing a glow plug pair.

11. An apparatus, as set forth in claim 10, including:

divider circuit that receives signals indicative of a respective glow plug current and voltage and produces a signal indicative of the particular glow plug resistance;

a ballast regulator receives the particular glow plug resistance signal, compares the actual glow plug resistance to a desired glow plug resistance and produces a ballast signal; and a ballast being connected in series with the particular glow plug, the ballast receiving the ballast signal, modifying the resistance thereto to regulate the amount of power dissipated by the ballast thereby controlling the amount of power consumed by the glow plug.

12. A method for controlling the temperature of a plurality of glow plugs of a multi-cylinder internal combustion engine, comprising the steps of:

sensing the voltage across the plurality of glow plugs and producing signals relative to the magnitude of the sensed voltage;

sensing the current across the plurality of glow plugs and producing signals relative to the magnitude of the sensed current;

receiving the sensed voltage and current signals, dividing the sensed signals, and producing a sensed resistance signal indicative of the average resistance of the glow plugs;

receiving the sensed resistance signal, comparing the magnitude of the sensed resistance signal with a preselected magnitude indicative of a predetermined glow plug temperature, and responsively producing a current command signal; and receiving the current command signal and responsively delivering alternating current to the glow plugs.

13. A method, as set forth in claim 12, including the steps of storing a software map containing a plurality of preselected resistance magnitudes that correspond to a plurality of engine operating parameters, the microprocessor selecting the one of the plurality of preselected resistance magnitudes producing a desired resistance signal.

14. An apparatus, as set forth in claim 13, including the steps of:

receiving the sensed resistance signal and converting the alternating current form of the sensed resistance signal to a direct current form;

receiving and comparing the converted resistance signal and the desired resistance signal, and producing a resistance error signal in response to the comparison; and receiving the resistance error signal, multiplying the error signal by a gain value; and producing the command signal.

15. A method, as set forth in claim 14, including the step of producing a three phase alternating current voltage, each phase energizing a glow plug pair.

16. A method, as set forth in claim 15, including the steps of:

receiving signals indicative of a particular glow plug current and voltage and producing a signal indicative of the particular glow plug resistance;

receiving the particular glow plug resistance signal, comparing the actual glow plug resistance to a desired glow plug resistance and producing a ballast signal; and receiving the ballast signal, and modifying the amount of power consumed by the glow plug to control the glow plug resistance to the desired resistance value.

* * * * *